US006890191B1

(12) United States Patent
Thorburn

(10) Patent No.: US 6,890,191 B1
(45) Date of Patent: May 10, 2005

(54) FEED THROUGH AND COMMON GROUND FOR ELECTRICAL CABLES

(75) Inventor: Neil Thorburn, Edinburgh (GB)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/708,469

(22) Filed: Mar. 5, 2004

(51) Int. Cl.[7] ..... H01R 4/66
(52) U.S. Cl. ..... 439/98; 439/610
(58) Field of Search ..... 439/610, 98, 579, 439/99, 394, 425, 785, 190, 796; 174/65, 35, 74, 78

(56) References Cited

U.S. PATENT DOCUMENTS 3,958,852 A * 5/1976 Abraham et al. ..... 439/355
4,201,433 A * 5/1980 Caldwell ..... 439/98
4,464,583 A 8/1984 Holmgren
5,295,863 A 3/1994 Cady
5,377,939 A * 1/1995 Kirma ..... 248/68.1
5,606,150 A 2/1997 Radliff et al.
5,636,306 A 6/1997 Mock et al.
5,713,748 A * 2/1998 Mulvihill ..... 439/98
5,834,693 A * 11/1998 Waddell et al. ..... 174/65 R
5,850,056 A 12/1998 Harwath
5,889,340 A * 3/1999 Miller et al. ..... 310/12
5,928,007 A 7/1999 Lundback
6,011,218 A 1/2000 Burek et al.
6,124,550 A 9/2000 Funken et al.
6,201,184 B1 3/2001 Francois et al.
6,227,251 B1 5/2001 Ahn et al.
6,297,447 B1 10/2001 Burnett et al.
6,413,103 B1 7/2002 Merz et al.
6,422,900 B1 7/2002 Hogan
6,540,531 B2 * 4/2003 Syed et al. ..... 439/98
6,548,762 B2 4/2003 Jiles et al.
6,623,303 B2 * 9/2003 Syed et al. ..... 439/610
6,645,007 B1 11/2003 Ko

* cited by examiner

*Primary Examiner*—Ross Gushi
*Assistant Examiner*—Phuongchi Nguyen
(74) *Attorney, Agent, or Firm*—Babcock IP, LLC

(57) ABSTRACT

A common ground assembly for a plurality of electrical cables with a ground strap having a plurality of cable retaining portions adapted to receive and contact the outer conductor of each electrical cable. Inwardly projecting lip edges may be formed in the cable retaining portions to retain each electrical cable within a cable retaining portion. The ground strap may be electrically isolated from surrounding structure by a support insulator and a retaining insulator with cable retaining portions adapted to further urge each outer conductor into electrical contact with a cable retaining portion. If integrated with a feedthrough in the form of a base plate with an aperture, a flange of the baseplate may support the support insulator and a fastening plate may be used to compress the retaining insulator towards the ground strap, the fastening plate dimensioned to cover the aperture.

19 Claims, 8 Drawing Sheets

FEED THROUGH AND COMMON GROUND FOR ELECTRICAL CABLES

BACKGROUND OF INVENTION

1. Field of the Invention

The invention relates to apparatus for electrical cable coupling. More particularly, the invention relates to a cost effective coupler for multiple electrical cables that may incorporate bulkhead penetration, useful as a component of a lightning protection system.

2. Description of Related Art

Electrical cables, for example coaxial transmission lines of antenna towers, are grounded to provide an electrical path to ground for dissipation of electrical current resulting from, for example, static discharge and or lightning strikes. Industry standards such as IEC 1024-1 and MIL-STD-188-124A have been developed to ensure that the grounding electrical circuit can handle expected current and voltage levels. According to these standards, each part of the grounding electrical circuit is provided with, for example, galvanically compatible interconnections having a minimal cross connection resistance of less than 1 milliohm and a conductor cross sectional area of at least 16 millimeters-squared (where the conductor is copper material).

Prior electrical grounding solutions have included clips, straps or the like for connection to the outer conductor of the cable and or connector unions placed in-line along the electrical cable. Individual interconnections with each cable and then to a grounding bus create a significant cost which increases with each additional cable that requires grounding. Further, each individual interconnection must be tightened to a specified torque level or the electrical resistance across the interconnection may unacceptably vary.

To form a secure electrical connection with the outer conductor, any outer protective covering of the cable is removed, creating an entry path for moisture that may, over time, degrade the exposed conductor and or the quality of the electrical connection(s). Prior electrical grounding solutions have typically included a sealing component such as gaskets, waterproofing wraps and the like. Proper application of these sealing solutions may require trained and motivated installation personnel.

As electrical cables enter a structure, they are typically routed through dedicated apertures of a bulkhead penetration panel that supports and seals each cable. Prior grounding solutions incorporated into bulkhead penetration panels have required a large number of individual components for sealing the cable entry, electrically coupling with the outer conductor of each cable and then to a common ground bus. The large number of discrete components and interconnections involved resulting in prior solutions with significant manufacturing costs, installation labor requirements and administrative overhead.

Competition within the electrical cable and associated accessory industries has focused attention on cost reductions resulting from increased manufacturing efficiencies, reduced installation requirements and simplification/overall number of discrete parts reduction.

Therefore, it is an object of the invention to provide an apparatus that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
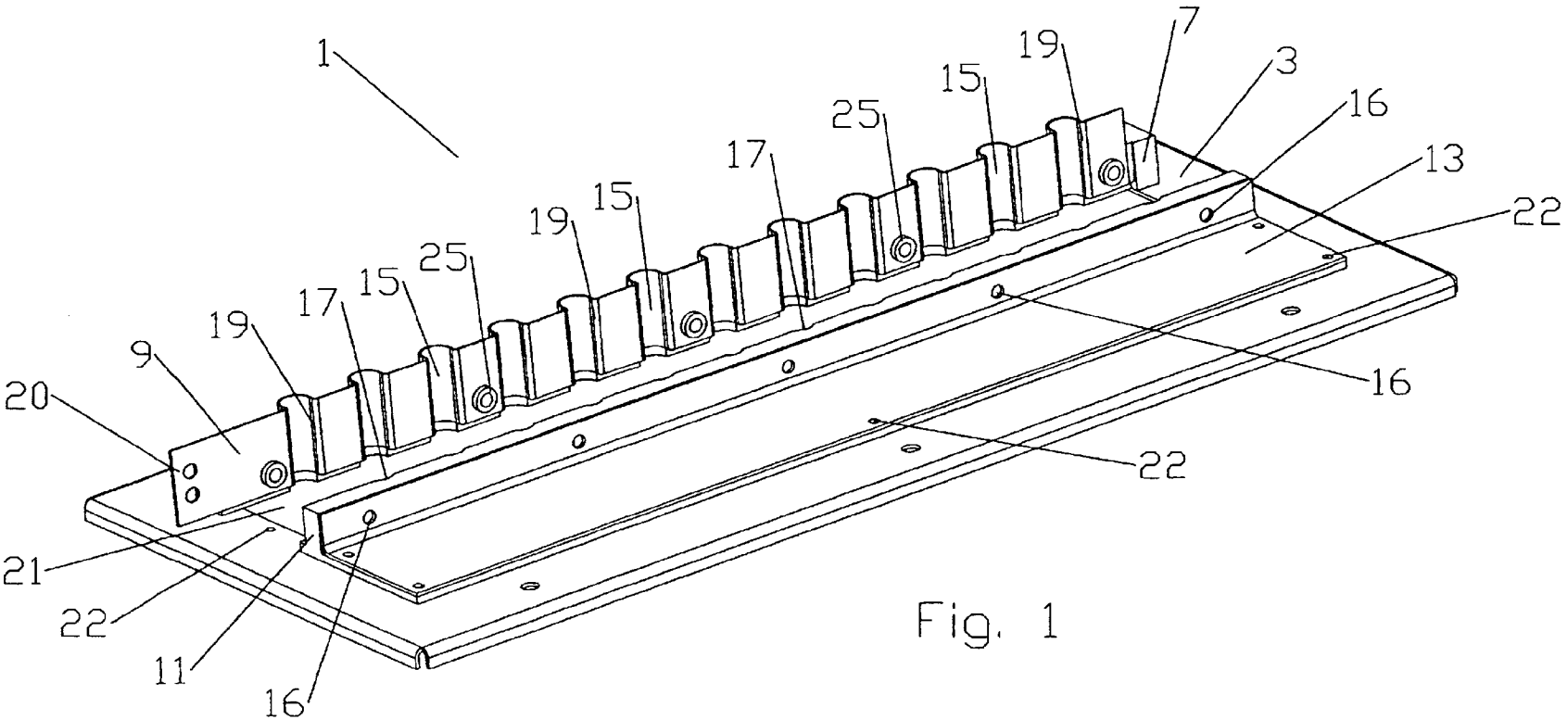
FIG. 1 is an isometric schematic view of the inside facing surface of a first embodiment of the invention, in an open position.
Figure 2:
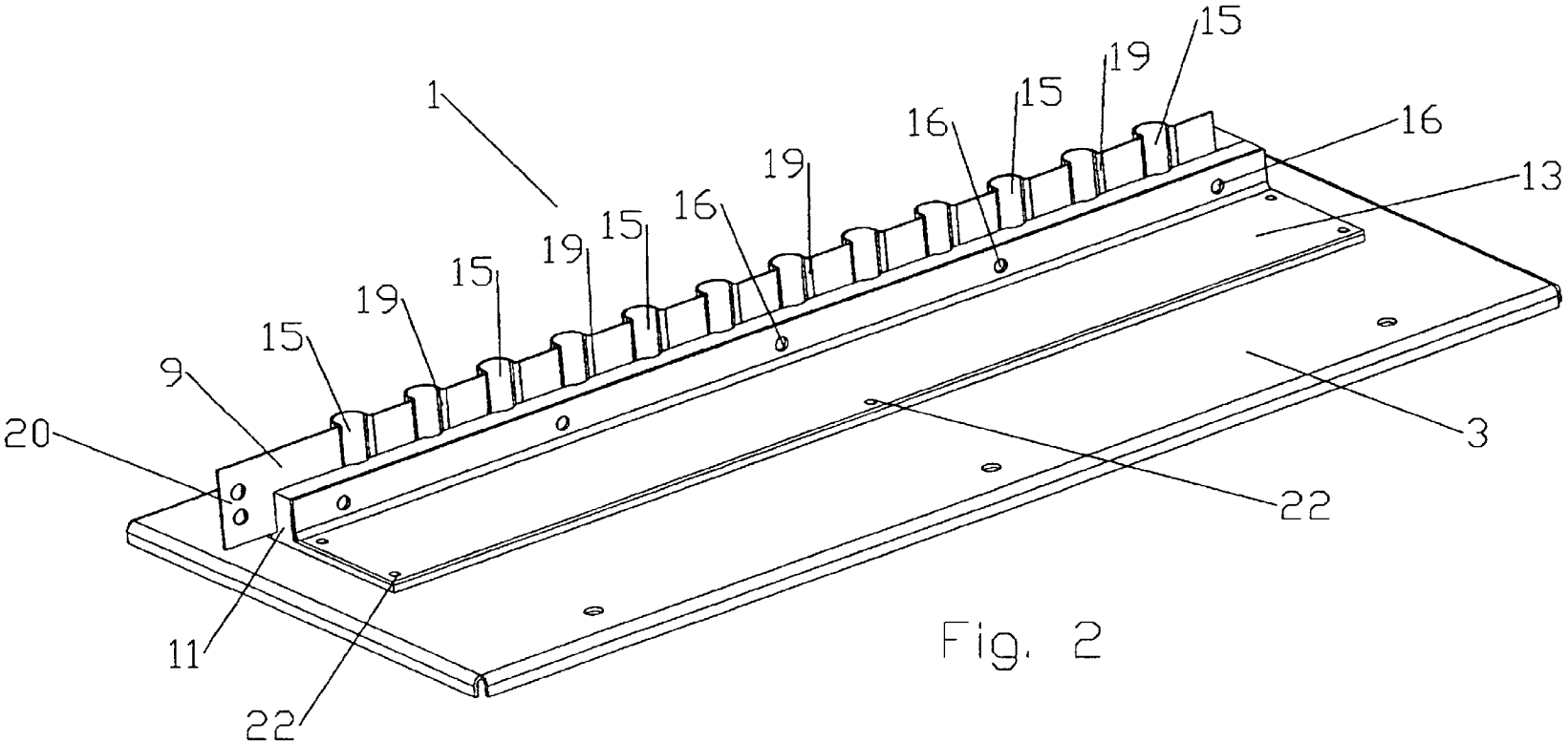
FIG. 2 is an isometric schematic view of the inside facing surface of a first embodiment of the invention, in a closed position.
Figure 3:
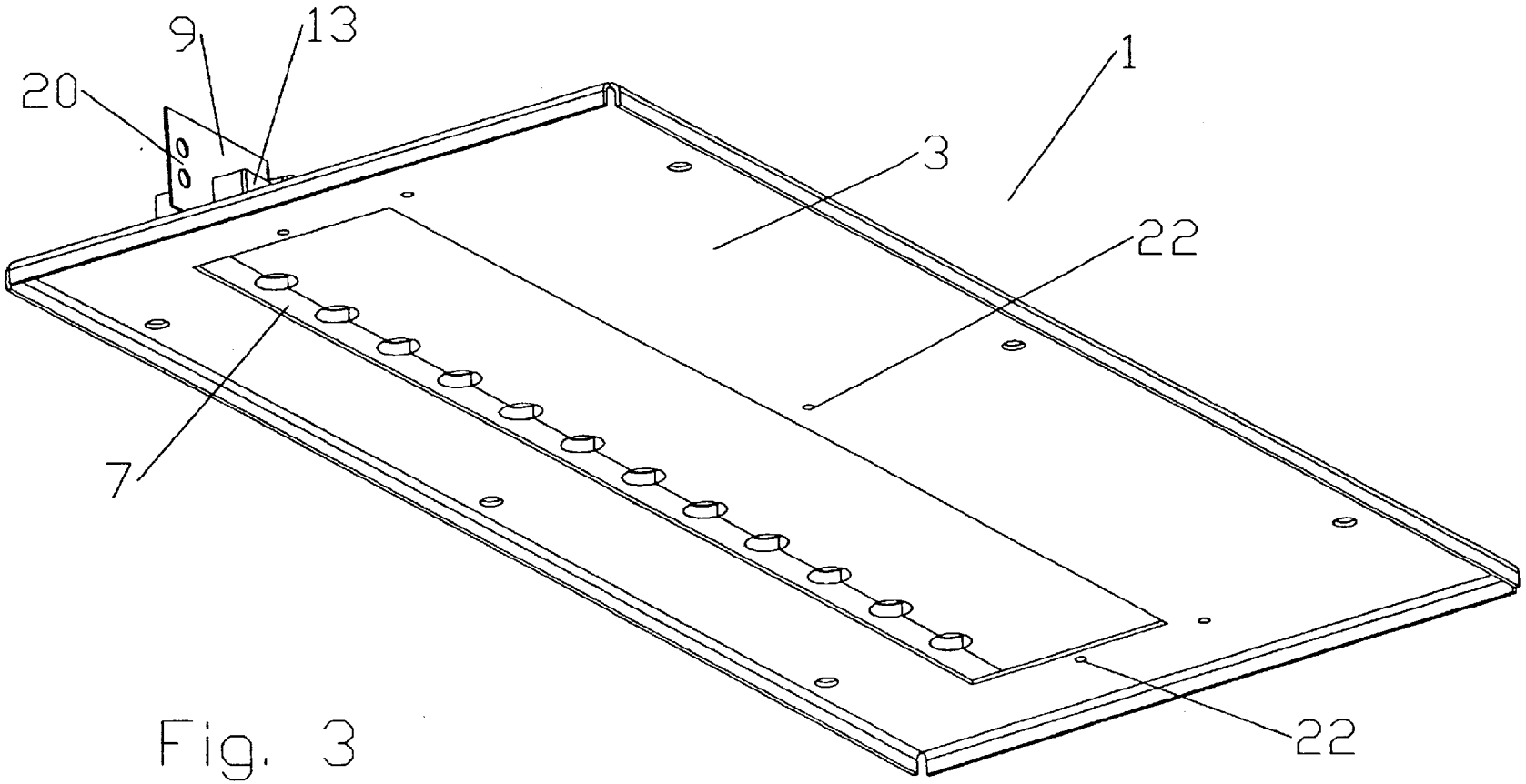
FIG. 3 is an isometric schematic view of the outside facing surface of a first embodiment of the invention, in a closed position.

The invention is described in an exemplary first embodiment with reference to the various views of the first embodiment shown in FIGS. 1–5. The invention is described herein with respect to an electrical cable having an outer conductor. The electrical cable may be any type of, for example, coaxial cable, waveguide, multiple conductor cable or the like. Further, different types of electrical cable may be coupled together by the invention.

A feedthrough and common ground for electrical cables (FCGEC) 1 according to the first embodiment of the invention has a base plate 3 with an inward projecting flange 5 against which a support insulator 7 is seated. The support insulator 7 supports, electrically isolated from the base plate 3, a ground strap 9. A retaining insulator 11 and a fastening plate 13 are adapted to mate with the ground strap 9 to secure electrical cables (not shown) installed within a plurality of cable receiving portion(s) 15 formed in the ground strap 9. A plurality of corresponding compression hole(s) 16 may be formed in the fastening plate 13, retaining insulator 11, ground strap 9, support insulator 7 and the flange 5 for compression bolts, screws or the like (not shown) which, upon installation, operate to join and compress the components together creating a secure, low resistance electrical connection between the outer conductor of each electrical cable and the ground strap 9.

Figure 4:
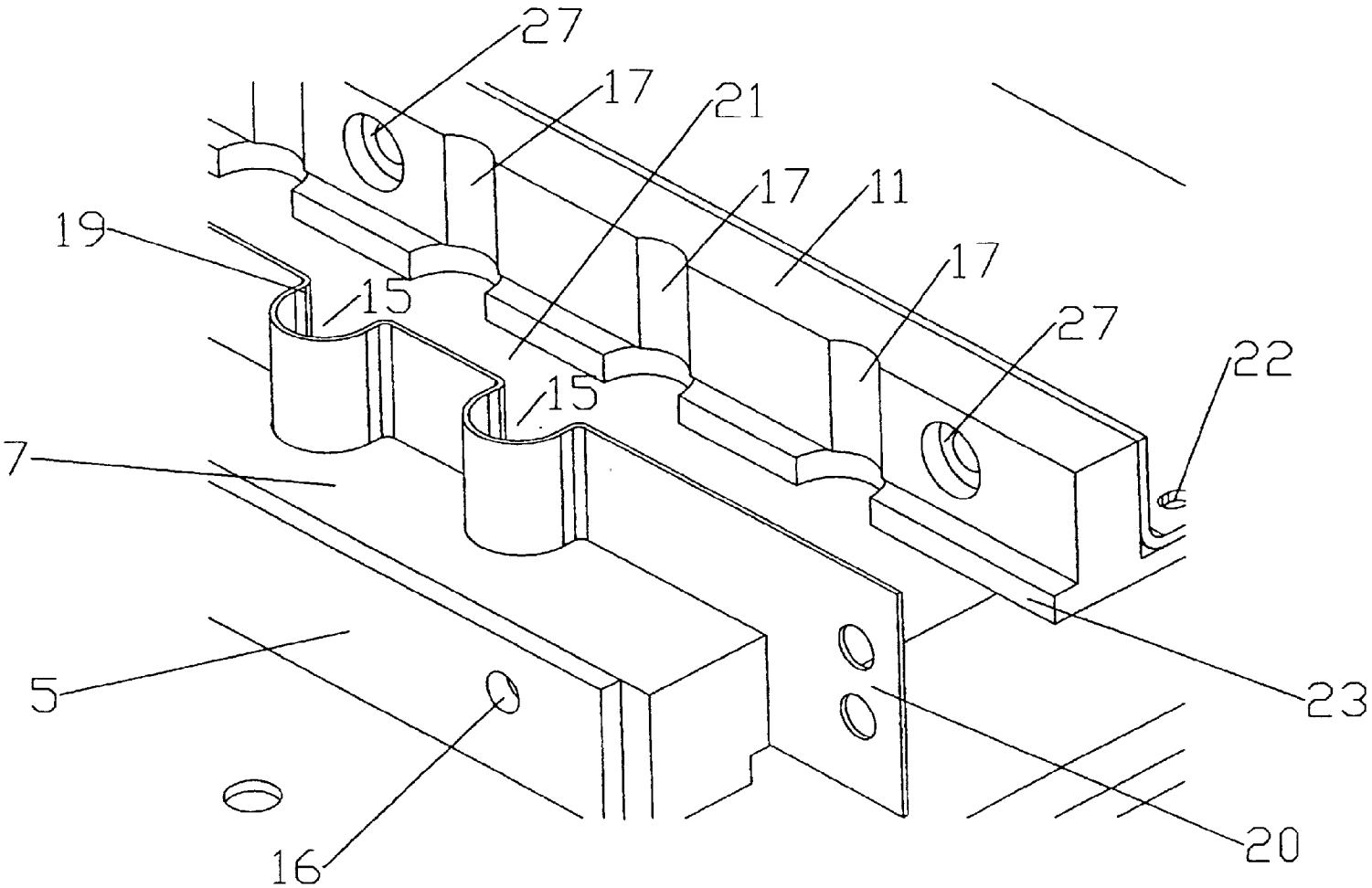
FIG. 4 is an isometric schematic close-up view of the grounding strap cable contact surfaces of the first embodiment.
Figure 5:
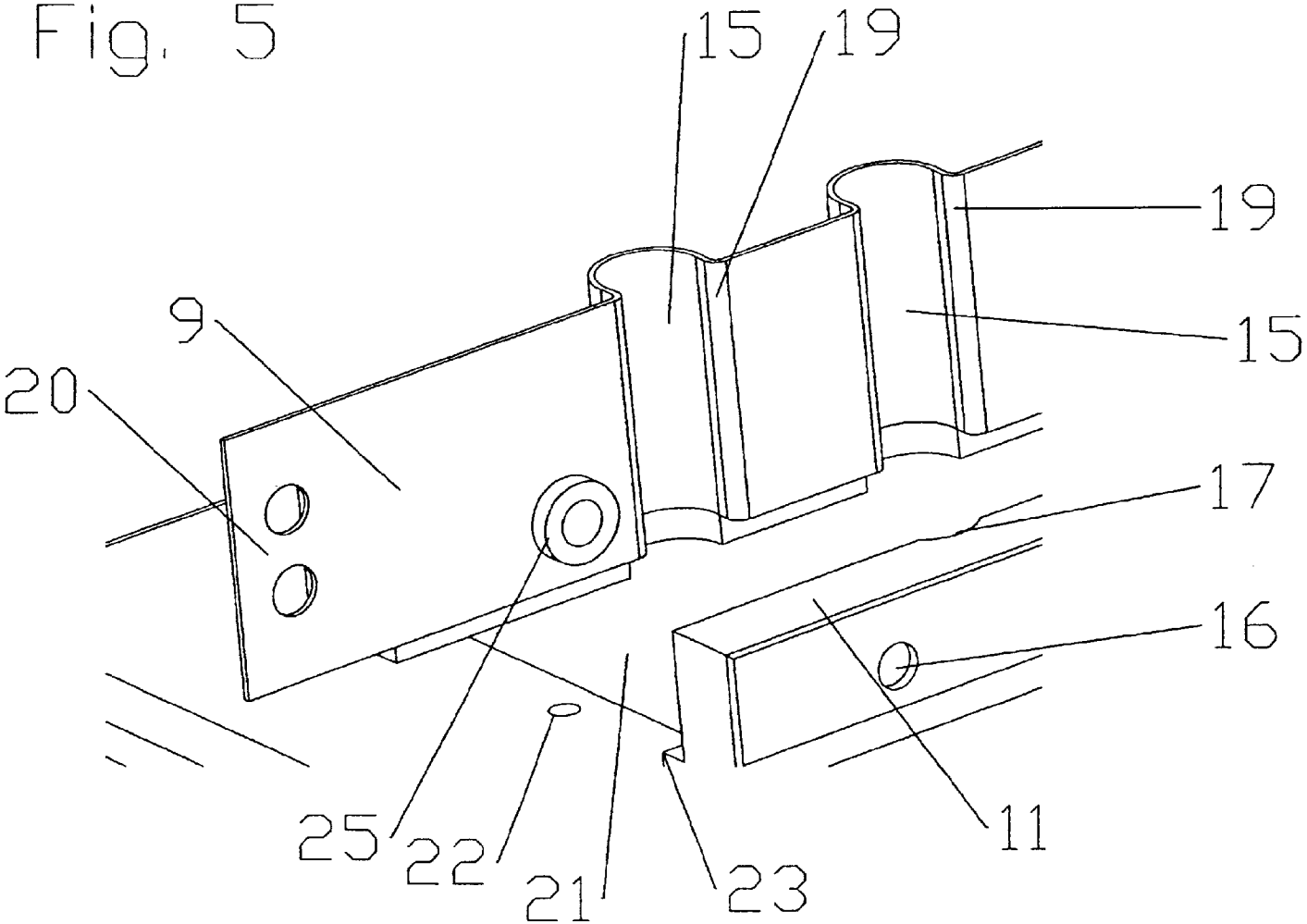
FIG. 5 is an isometric schematic close-up view of the sealing gasket cable contact surfaces of the first embodiment.

As best shown in FIGS. 4 and 5, respectively, each cable receiving portion 15 of the ground strap 9 and a corresponding retaining insulator 11 cable retaining portion 17 has an inner diameter adapted to receive the outer conductor of the desired electrical cable. Similarly, the invention may be adapted for use with cables with other than circular cross sections, for example, an oval transmission line by adapting the cable receiving portion 15 and cable retaining portion 17 to mate with the corresponding oval outer cross section of the transmission line.

Lip edge(s) 19 protruding radially inward to a smaller diameter than the cable receiving portion 15 may be formed at the top edge of the cable receiving portion(s) 15 to create a press into place retaining function for an electrical cable pressed past the lip edge(s) 19 into each cable receiving portion 15.

The ground strap 9 is formed from a metal or metal alloy, for example copper, which is galvanically compatible with the outer conductor of the desired electrical cable. A ground bus connection point 20 for coupling the ground strap 9 to earth ground may be formed, for example, at one end of the ground strap 9. Preferably formed from a single piece of the selected material, the ground strap 9 may be dimensioned to have at least a minimum cross sectional area according to the applicable electrical standard. Further, the ground strap 9 may be dimensioned to have a length, along the longitudinal axis of the electrical cable that provides suitable contact area with the electrical cable. Where the outer conductor of the electrical cable is corrugated, reducing the contact area, the length may be extended accordingly.

An aperture 21 formed in the base plate 3 may be dimensioned to allow passage of electrical cables with connectors or other components already installed. Inserted through the aperture 21, each cable may be pressed into a cable receiving portion 15 where it is temporarily secured by the lip edge(s) 19. Unused cable receiving portion(s) 15 may be plugged with, for example, a length of scrap cable or other appropriately dimensioned plug. The fastening plate 13 is dimensioned to close the aperture 21 when in place upon the ground strap 9. The retaining insulator 11, supported by the fastening plate 13, may be shaped to also seal the closure of the fastening plate 13 upon the aperture 21. A series of retaining hole(s) 22 around the aperture 21 and fastening plate 13 periphery may be used to finally fix the fastening plate 13 into place upon the base plate 3 via removable fasteners such as screws (not shown).

The ground strap 9 may be electrically isolated from the base plate 3 and fastening plate 13 by forming a shoulder 23 in the support insulator 7 or retaining insulator 11. Similarly the compression bolt bolts may be isolated from the ground strap 9 by a plurality of protruding portion(s) 25 and corresponding depression(s) 27 in the support insulator 7 and retaining insulator 11 or vice versa. Preferably, the insulator material, in addition to non-conductivity, has resilient sealing properties. Suitable materials for the support insulator 7 and retaining insulator 11 include, for example, butyl rubber, nitril, epdm and silicon. The shoulder 23 also operates to seal the ground strap 9 from the outside environment and allows the support insulator 7 to seat against the retaining insulator 11 sealing around the outer conductor of each electrical cable to inhibit moisture infiltration.

Figure 6:
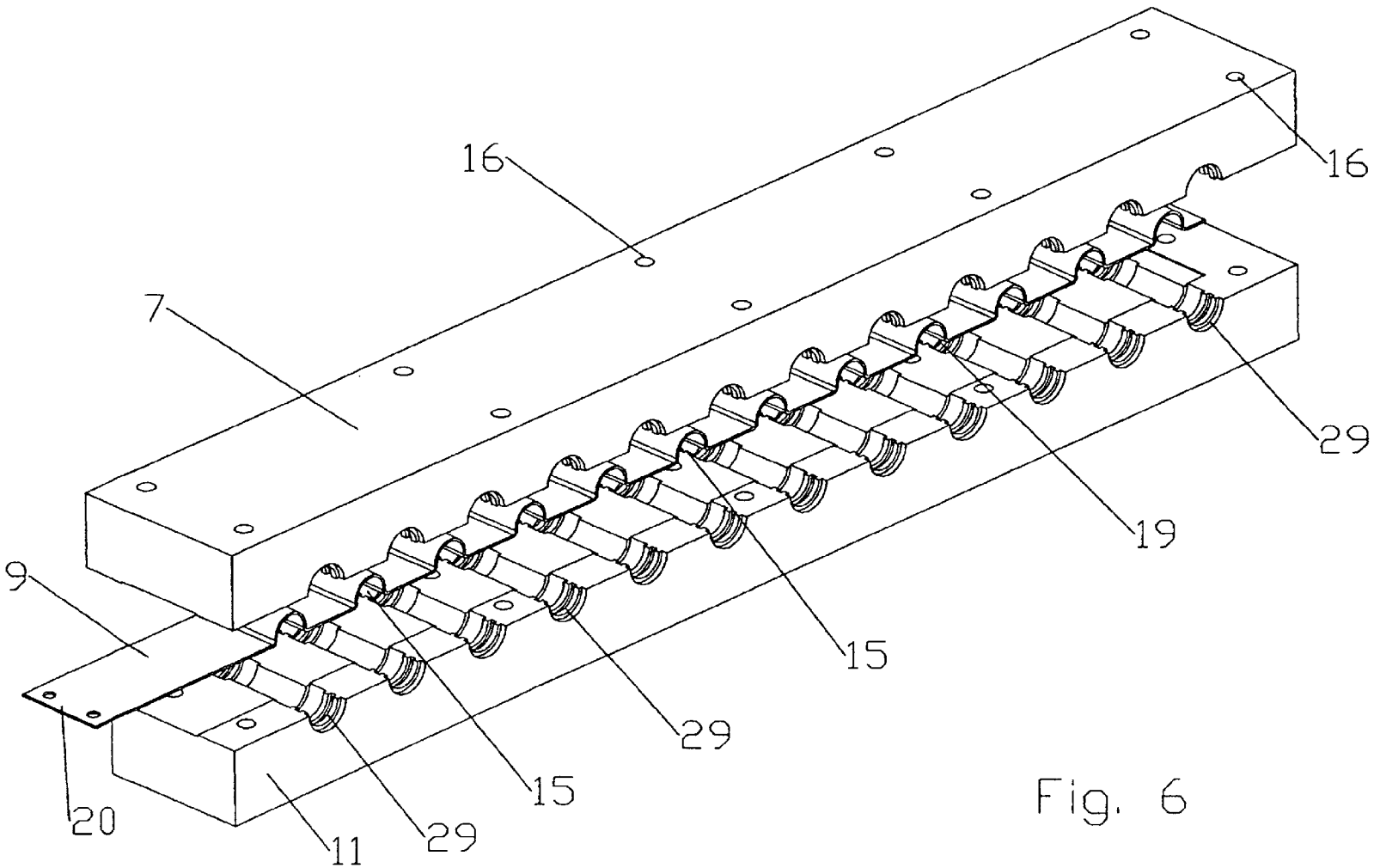
FIG. 6 is an isometric exploded schematic view of a second embodiment of the invention.
Figure 7:
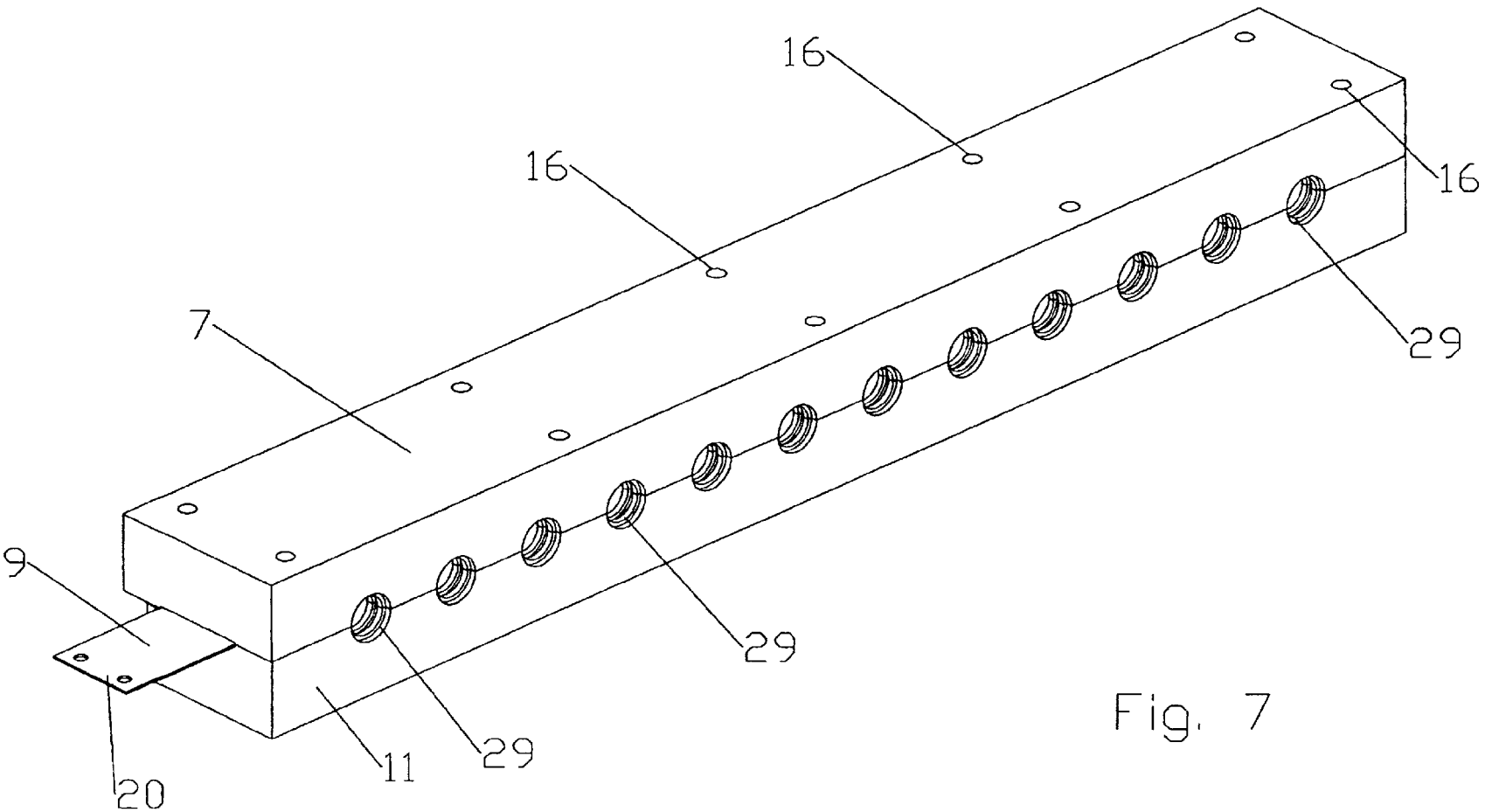
FIG. 7 is an isometric schematic view of the second embodiment of the invention, assembled.
Figure 8:
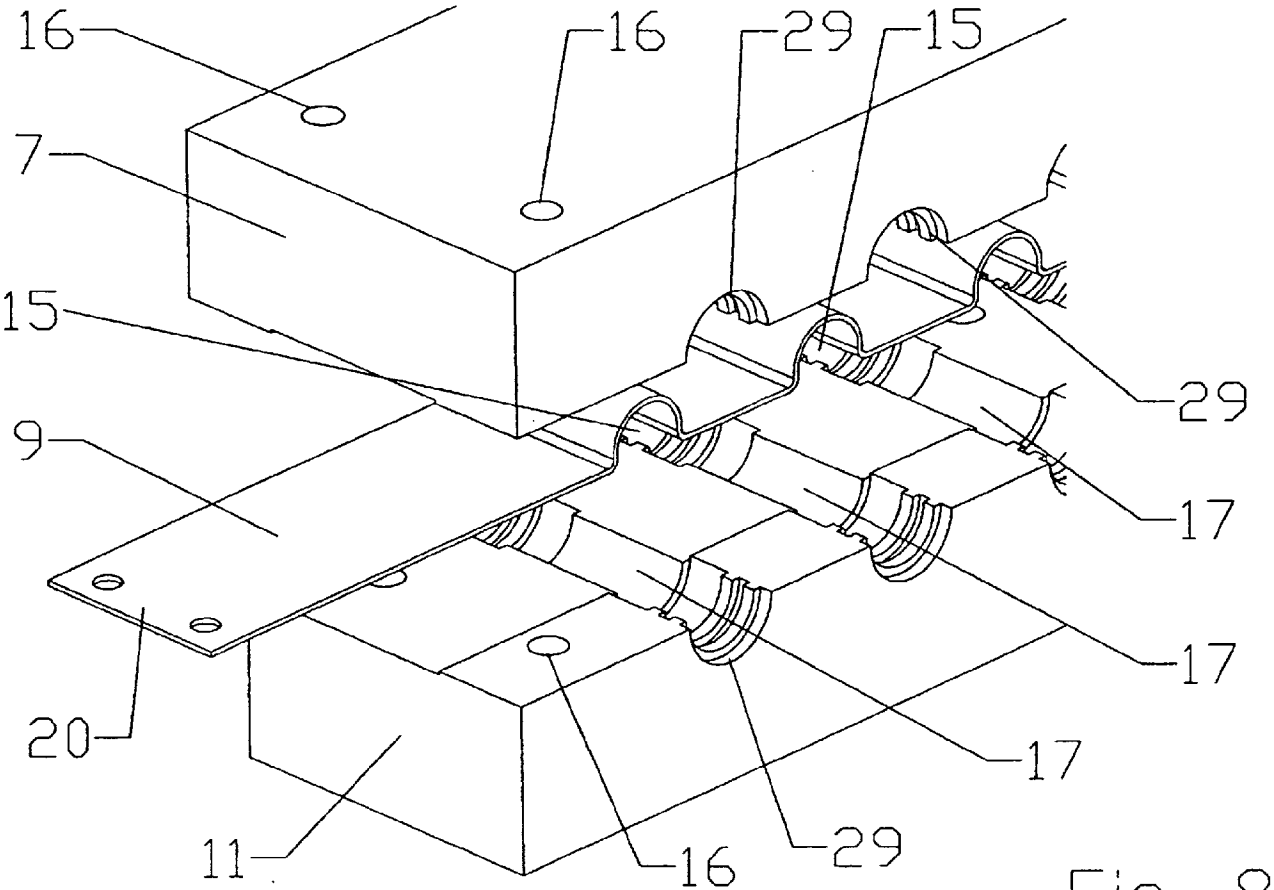
FIG. 8 is a close up view of FIG. 6.

The first embodiment is demonstrated as a 12 electrical cable configuration. In alternative embodiments, the number of electrical cables the FCGEC 1 is adapted to receive may be varied. For common interconnection of electrical cable outer conductors where a feedthrough is not required, for example along an exterior cable run or near the top of an antenna tower, a second embodiment as shown in FIGS. 6–8 may be applied. Here, like components similarly notated, the ground strap 9 may be isolated except for the protruding connection point 20 by enclosure between an oversized support insulator 7 and retaining insulator 11. Also, support insulator 7 to retaining insulator 11 direct contact is applied on both sides of the ground strap 9, along the longitudinal axis of the electrical cable. To further improve the sealing effect of the respective insulators upon and around each outer conductor of the electrical cables, sealing fin(s) 29 may be applied to cable outer conductor contacting surfaces of each insulator adapted to mate with corrugations in the outer conductor of the cable.

The present invention provides a cost effective common coupling solution with a reduced number of components. Installation is simplified by the wide common aperture 21 available for inserting each cable and the ability of the ground strap to retain each cable prior to final installation of the fastening plate 13. Because the ground strap is formed from a single piece of material, costs may be reduced and the opportunity for faulty installation minimized. In embodiments without bulkhead penetration features, the invention similarly reduces costs and installation requirements.

Table of Parts

| | |
|---|---|
| 1 | FCGEC |
| 3 | base plate |
| 5 | flange |
| 7 | support insulator |
| 9 | ground strap |
| 11 | retaining insulator |
| 13 | fastening plate |
| 15 | cable receiving portion |
| 16 | compression hole |
| 17 | cable retaining portion |
| 19 | lip edge |
| 20 | connection point |
| 21 | aperture |
| 22 | retaining hole |
| 23 | shoulder |
| 25 | protruding portion |
| 27 | depression |
| 29 | sealing fin |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A grounding assembly for the outer conductor of a plurality of electrical cables, comprising:

a ground strap with a plurality of cable receiving portions formed in a first side;

each of the cable receiving portions adapted to mate with a first section of an outer diameter of the outer conductor of each of the electrical cables;

a retaining insulator adapted to mate with the first side of the ground strap;

the retaining insulator having a plurality of cable retaining portions adapted to mate with a second section of the outer diameter of the outer conductor of electrical cables in the cable receiving portions; and a support insulator adapted to mate with a second side of the ground strap.

2. The assembly of claim 1, wherein the ground strap is formed from a single piece of material.

3. The assembly of claim 1, wherein the ground strap has a cross sectional area of at least 16 millimeter-squared.

4. The assembly of claim 1, wherein each cable receiving portion has at least one lip edge protruding radially inward whereby the outer conductor is retained within the cable retaining portion upon insertion.

5. The assembly of claim 1, wherein the support insulator and the retaining insulator encapsulate the ground strap, except for a protruding ground strap connection point.

6. The assembly of claim 5, wherein portions of the support insulator and retaining insulator in contact with the outer conductor have a plurality of sealing fins adapted to mate with corrugations formed in the outer conductor.

7. The assembly of claim 1, further including a base plate with an aperture;

a flange projecting from an edge of the aperture adapted to support the support insulator; and a fastening plate adapted to support the retaining insulator;

the aperture dimensioned to allow passage of the electrical cables through the aperture to the cable receiving portions;

the fastening plate adapted to cover the aperture when the retaining insulator is seated upon the ground strap.

8. The assembly of claim 7, wherein the retaining insulator has a shoulder portion adapted to seal against the support insulator when the support insulator is seated against the ground strap.

9. The assembly of claim 7, wherein the retaining insulator extends to cover the extent of the fastening plate which faces the base plate.

10. The assembly of claim 7, further including a plurality of compression holes extending through the flange, the support insulator, the ground strap, the retaining insulator and the fastening plate.

11. The assembly of claim 10, wherein a protruding portion having a compression hole there through of the support insulator protrudes through each ground strap compression hole;

the retaining insulator having a corresponding depression adapted to receive the protruding portion, whereby the compression holes are insulated from the ground strap.

12. A feedthrough and common ground assembly for a plurality of electrical cables having an outer conductor, comprising:

a baseplate with an aperture;

a support insulator supported by the baseplate;

a ground strap with a plurality of cable receiving portions, each cable receiving portion adapted to receive and electrically contact the outer conductor of one of the electrical cables;

the ground strap seated upon the support insulator whereby electrical cables passing through the aperture may be seated in the cable receiving portions;

a retaining insulator adapted to seat against the ground strap having a plurality of cable retaining portions corresponding to the cable receiving portions, the cable retaining portions adapted to seal against an exposed portion of the outer conductor of the electrical cables seated in the cable receiving portions; and a fastening plate adapted to support the retaining insulator and cover the aperture when the retaining insulator is seated against the ground strap.

13. The assembly of claim 12, wherein the support insulator is seated upon a flange formed in the baseplate at an edge of the aperture.

14. The assembly of claim 12, wherein the cable retaining portion has at least one inwardly protruding lip edge operable to retain the electrical cable within the cable retaining portion.

15. The assembly of claim 12, wherein the retaining insulator is adapted to cover the aperture when the retaining insulator is seated upon the ground strap.

16. The assembly of claim 12, wherein the support insulator and the retaining insulator electrically insulate the ground strap from the base plate.

17. The assembly of claim 12, wherein the ground strap has a length along the longitudinal axis of the electrical cables whereby when each electrical cable is placed within a cable receiving portion, the outer conductor of the electrical cable has an electrical contact area with the ground strap according to one of IEC 1024-1 and MIL-STD-188-124A.

18. The assembly of claim 12, wherein the ground strap has a cross sectional area of at least 16 millimeters-squared.

19. The assembly of claim 12, wherein the ground strap is formed from a single piece of material.

* * * * *